United States Patent [19]

van Buren, Jr.

[11] 4,160,887

[45] Jul. 10, 1979

[54] CLOSURE ACTIVATED SWITCH

[75] Inventor: Harold S. van Buren, Jr., Lexington, Mass.

[73] Assignee: TRW Inc., Cleveland, Ohio

[21] Appl. No.: 822,461

[22] Filed: Aug. 8, 1977

[51] Int. Cl.[2] ..... H01H 3/16

[52] U.S. Cl. ..... 200/61.62; 200/61.7; 362/80; 362/155; 362/365

[58] Field of Search ..... 16/179, DIG. 13; 200/61.58 B, 61.62, 61.64, 61.67, 61.68, 61.7, 61.81, 61.82, 159 R, 295, 296, 339; 362/61, 75, 80, 295, 306, 362, 365, 94, 155, 802, 154

[56] References Cited

U.S. PATENT DOCUMENTS

| | | | |
|---|---|---|---|
| 2,816,972 | 12/1957 | Haut | 200/61.62 |
| 3,048,674 | 8/1962 | Hopkins | 200/61.7 |
| 3,193,673 | 7/1965 | Herring | 362/80 |
| 3,320,607 | 5/1967 | Rueger | 362/365 X |
| 3,403,236 | 9/1968 | Zoludow | 200/339 X |
| 3,548,131 | 12/1970 | Piber | 200/295 X |
| 3,553,448 | 1/1971 | Davis et al. | 362/80 |
| 3,576,409 | 4/1971 | Fiddler | 362/80 X |
| 3,597,564 | 8/1971 | Lewis | 200/296 |
| 3,692,992 | 9/1972 | Bain et al. | 200/61.62 X |
| 4,070,555 | 1/1978 | Carli | 200/339 |

*Primary Examiner*—James R. Scott

*Attorney, Agent, or Firm*—James R. O'Connor; Martin J. O'Donnell; Thomas C. O'Konski

[57] ABSTRACT

A switch operates a lamp bulb in a compartment in response to the opening and closing of the compartment's lid. The switch includes a housing that retains the bulb and mounts in an aperture adjacent the compartment. The housing includes a hinge that is pivoted from a first to a second position when the lid is closed. A pair of contacts on opposite sides of the housing include terminals which connect into an electrical circuit. One end of one contact engages the bulb contact. One end of the other contact engages the bulb base and biases the hinge member into its first position. When the lid is open, the hinge is in its first position and the circuit through the bulb is complete. Closing of the lid pivots the hinge to its second position and moves the end of the other contact away from the bulb to break the circuit.

17 Claims, 7 Drawing Figures

CLOSURE ACTIVATED SWITCH

BACKGROUND OF THE INVENTION

1. Field of the Invention

This invention relates generally to switches and, more particularly, to a switch that is adapted for use with a compartment having an access opening closable by a closure member and that is activated in response to the opening and closing of the compartment by the closure member. The switch is particularly adapted for use with storage compartments of the type found in automotive vehicles to control the energization of a lamp bulb used to illuminate the compartment.

2. Description of the Prior Art

Closure activated switches are presently used in a variety of fields including, for example, automotive vehicles, domestic appliances and alarm and anti-theft systems. In a typical prior construction, the switch includes a pushbutton or plunger that is biased by a spring into a protruding position and that is disposed so as to be depressed against the action of the spring upon the closing of a closure member. The plunger operatively engages other components within the switch so that, when the plunger is depressed, an electrical circuit through the switch is either made or broken. Examples of prior closure activated switches are shown in the following U.S. Pat. Nos. 2,615,083; 3,048,674; 3,157,756; 3,193,673; 3,393,281; 3,432,634; 3,440,373; and 3,609,265.

For most applications, and particularly for automotive applications, it is important that the closure activated switch be relatively simple and inexpensive to manufacture, simple to install and simple to replace in the event that the need arises. Also, it is generally expected that the switch will operate reliably for long periods of time even though subjected to a variety of vibrational and shock forces resulting from the constant engagement and disengagement of the switch by the closure member. As can be appreciated from a review of the above patents, a major drawback of many prior switches is their relative complexity and relatively large number of operating parts. This complexity not only adds to the cost of manufacturing the switches, but also oftentimes increases the likelihood of their pre-mature failure because of the number of parts that are susceptible to failure.

OBJECTS OF THE INVENTION

A primary object of the present invention is to provide an improved closure-activated switch.

Another object of the invention is to provide an improved closure-activated switch that includes relatively few operational parts, each of which is simplified, relatively inexpensive to manufacture and easy to assemble.

Another object of the invention is to provide a closure activated switch of the type described that is easy to install relative to a closure member and easy to remove if the need arises.

Another object of the invention is to provide a closure activated switch of the type described that is adapted to retain a lamp bulb and to energize and de-energize the lamp bulb in response to the movement of a closure member relative thereto.

Still another object of the invention is to provide a closure activated switch of the type described that is particularly adapted for use in conjunction with a storage compartment within an automotive vehicle.

SUMMARY OF THE INVENTION

Briefly, a closure activated switch fabricated in accordance with the invention includes three basic components: a housing; a first contact member; and, a second contact member. The housing is adapted for mounting relative to a compartment including a closure lid and includes an integral or "living" hinge member that is disposed so as to be engaged by a closure lid and pivoted from a first position to a second position in response to the closing of the lid. The housing also includes a lamp bulb receiving portion in which a lamp bulb for illuminating the compartment is retained.

The first contact member is mounted to the housing and includes a first end that serves as one terminal of the switch for connection into an electrical circuit and a second end that extends into the housing so as to contact the bulb. The second contact member is also mounted to the housing but in such a manner as to be electrically isolated from the first contact member. A first end of the second contact member serves as the other terminal of the switch while a second end of the second contact member extends relative to the housing in such a manner that it contacts and completes the electrical circuit through the bulb. When the closure lid is closed and the hinge member is forced to its second position, the hinge member engages and forces the second end of the second contact member away from the bulb to open or break the electrical circuit therethrough. The bulb is thus energized when the closure lid is open, but is automatically de-energized when the closure lid is closed.

In a preferred embodiment of the invention, the housing of the switch is fabricated as a one-piece molded plastic part. The integral hinge member eliminates the need for a separate pushbutton or plunger of the type found in prior switches. The one-piece housing also includes a pair of integral wing members that flex inwardly to enable the housing to be pushed through a mounting aperture disposed adjacent the closure lid and that resiliently return to their original position to retain the housing in the aperture. Removal of the housing for repair or replacement of the switch can be achieved simply by inwardly squeezing the wing members to enable them to pass back through the aperture.

The first and second contact members are also preferably fabricated as integral units but from a spring metal material. Advantage is taken of the resiliency of the contact members to insure a firm retention of the bulb in the housing, to insure good electrical contact to the bulb and to bias the hinge member to its first position to insure that the bulb is always energized when the closure lid is open. Thus, separate spring members need not be included in the switch to serve these purposes.

BRIEF DESCRIPTION OF THE DRAWING

The foregoing and other objects, features and advantages of the invention will be better understood from the following detailed description taken in conjunction with the accompanying drawing in which.

DETAILED DESCRIPTION OF PREFERRED EMBODIMENT

Figure 1:
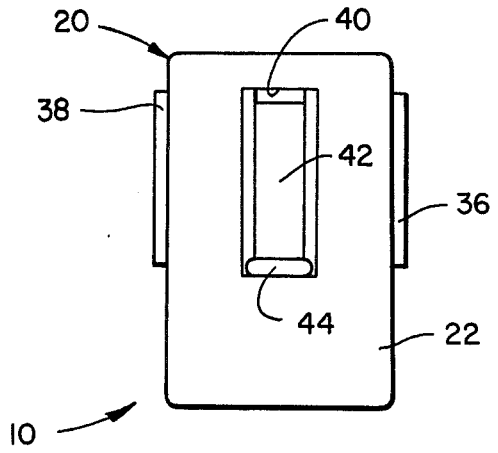
FIG. 1 is a front plan view of a closure activated lamp switch embodying the invention.
Figure 2:
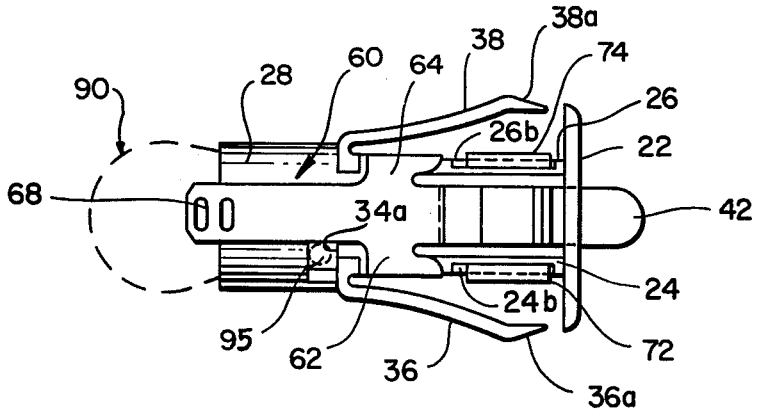
FIG. 2 is a top plan view of the switch of FIG. 1.

Referring now to the drawing, and particularly FIGS. 1–5 thereof, there is shown a closure activated lamp switch embodying the invention and indicated generally by the reference numeral 10. As can be appreciated from the drawing, the switch 10 comprises three basic components: a housing 20; a first spring contact member 60; and a second spring contact member 70. The housing 20, which is preferably fabricated as an integral unit from a plastic material, is adapted to carry the contact members 60 and 70 and a lamp bulb 90, which is shown in phantom in FIGS. 2, 3 and 4, and which is energized and deenergized by activation of the switch 10.

More specifically, the housing 20 includes a front plate portion 22 connected by a pair of substantially parallel side members 24 and 26 to a bulb receiving portion 28 at the rear of the housing 20. The bulb receiving portion 28 is cylindrical in shape and includes an opening 30 which is dimensioned and designed to receive and retain the base 92 of the bulb 90. The bulb 90 may, for example, be a standard automotive bulb, the base 92 of which includes a shell 93*a* tip contact 94, and a pair of radially projecting buttons 95 and 96 that enable the bulb to be pushed into the opening 30 and to be given a slight twist to retain it there. The bulb receiving portion 28 of the housing 20 may thus include a pair of opposed inside grooves 32*a* and 32*b* (FIG. 5) in which the bulb buttons 95 and 96 are guided as the bulb is pushed into the opening 30. A pair of opposed openings 34*a* and 34*b* (FIGS. 2 and 4, respectively,) are located at the inner ends of the grooves and receive the buttons 95 and 96 when the bulb 90 is twisted. The openings 34*a* and 34*b* are laterally offset relative to the grooves 32*a* and 32*b* to prevent the bulb 90 from being withdrawn from the opening 30 without first twisting it in the opposite direction.

A pair of integral wing members 36 and 38 project from the sides of the housing 20. The wing members 36 and 38 project outwardly at an angle with respect to the side members 24 and 26 to a point just short of the front plate portion 22. The wing members 36 and 38 enable the housing 20 to be snapped into and retained within an aperture in a panel having dimensions slightly smaller than the length and width of the front plate portion 22. As the bulb end of the housing 20 is pushed through such an aperture, the wing members 36 and 38 flex toward their respective adjacent side members 24 and 26 until the free ends 36*a* and 38*a* thereof clear the aperture-defining edges of the panel and the front plate portion 22 is flush against the panel. The wing members 36 and 38 then return to their original position to retain the housing 20 in the aperture. The housing 20 can be removed from such an aperture if the need arises by squeezing the wing members 36 and 38 inwardly to enable them to pass back through the aperture. The free ends 36*a* and 38*a* of the wing members may be inwardly tapered, as indicated in the drawing, to facilitate the removal.

The front plate portion 22 of the housing 20 includes an elongated opening 40 through which an integral or "living" hinge member 42 is movable. The hinge member 42 normally projects out through the opening 40, but can be pivoted into the opening 40 about its lower or connecting end 44. The connecting end 44 of the member 42 is thinned down somewhat, as indicated in the drawing, to facilitate this pivotal motion. The inner end of the member 42 is provided with an upstanding lip 46 (FIG. 3) which prevents the member 42 from being pulled out through the opening 40. The inner end of the member 42 also includes a projecting finger 48 which engages a portion of the spring contact member 70 within the housing 20. As will be better appreciated as the description proceeds, the switch 10 is activated to control the bulb 90 by pivoting the hinge member 42 relative to the front plate portion 22 of the housing.

Figure 3:
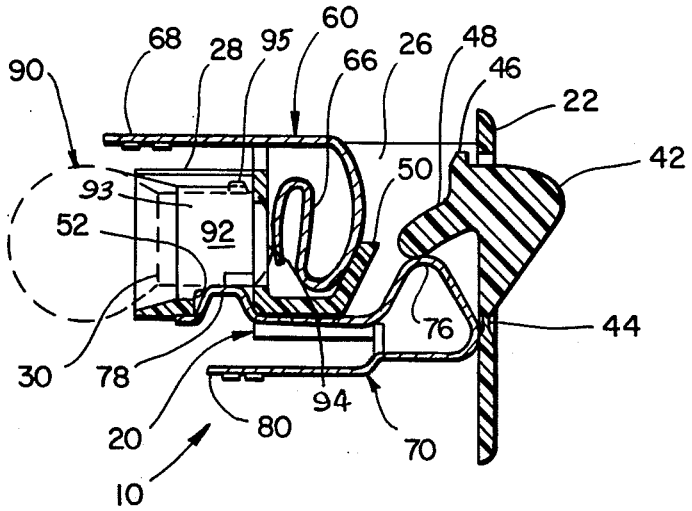
FIG. 3 is a side view in section of the switch of FIG. 1.
Figure 4:
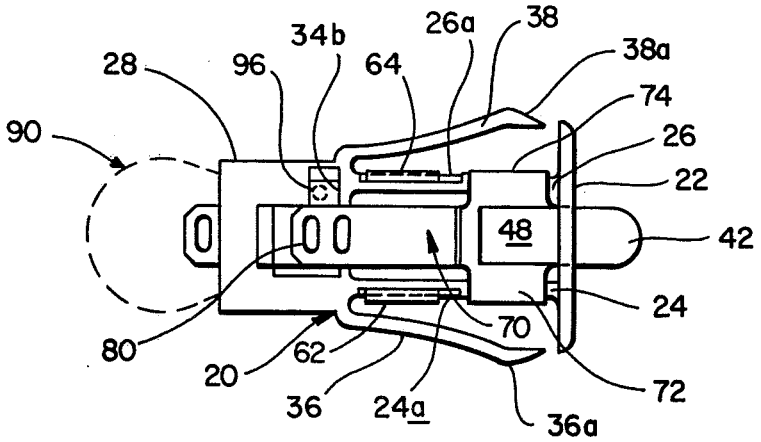
FIG. 4 is a bottom plan view of the switch of FIG. 1.
Figure 5:
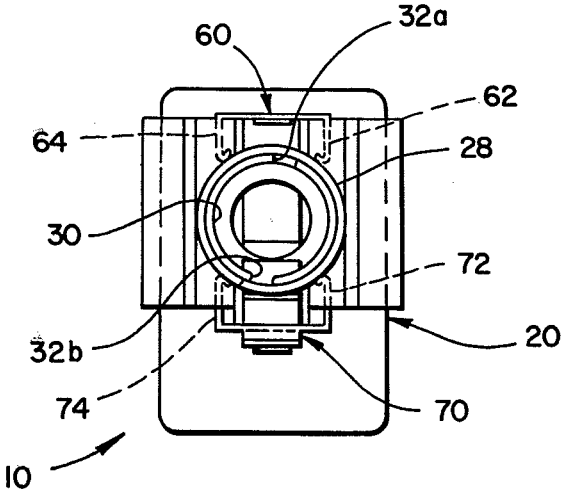
FIG. 5 is a rear plan view of the switch of FIG. 1.

The first spring contact member 60 is secured to the upper end of the housing 20. As can be best seen by referring first to FIG. 2 and then to FIG. 4 of the drawing, the member 60 includes a pair of counter-extending webs 62 and 64 that are first bent downwardly along the outside surface of the side members 24 and 26, respectively, and that are then bent inwardly so that they engage under downwardly facing ridges 24*a* and 26*a*, respectively, (FIG. 4) formed in the side members. As seen in FIG. 3, one end 66 of the member 60 is bent into the shape of an "S" and extends into the housing 20 where it is nested between an upstanding wall member 50 in the housing 20 and the tip contact 94 of the base 92 of the bulb 90. The bend in the end 66 of the member 60 is such that it serves as a spring in biasing the bulb 90 out of the opening 30. This biasing action insures that the bulb 90 is firmly retained in the housing 20 and also insures that continuous contact is maintained between the member 60 and the tip of the bulb base 92.

The opposite end 68 of the member 60 extends toward the rear of the housing 20 and serves as a terminal for connection into an electrical circuit, typically, to a wire from the positive side of the vehicle battery. The end 68 is preferably dimpled so that a secure connection can be made thereto with a suitable wire connector.

The second spring contact member 70 is secured to the lower end of the housing 20 in such a manner as to be electrically isolated from the contact member 60. Like the member 60, the member 70 includes a pair of counter-extending webs 72 and 74 (FIG. 4) that are used for securing the member 70 to the housing. By referring first to FIG. 4 and then to FIG. 2, it can be seen that the webs 72 and 74 are first bent upwardly along the outside surface of the side members 24 and 26, respectively, and then bent inwardly so that they engage under upwardly facing ridges 24*b* and 26*b*, respectively (FIG. 2), formed in the side members.

As seen in FIG. 3, a portion 76 in the form of a node of the member 70 extends into the housing 20 and bends upwardly into engagement with the finger 48 projecting from the hinge member 42. The member 70 then extends rearwardly toward the bulb 90 where another upward bend or node 78 is formed. The bend or node 78 extends through an opening 52 in the bulb receiving portion 28 of the housing 20 and into contact with the side of the shell 93 of the bulb base 92. The bends or nodes in the member 70 are such that the apex of the bend or node 78 is normally biased into contact with the shell of the bulb base 92 and the bend or node 76 normally biases the finger 48 and hinge member 42 into the position illustrated in FIG. 3.

The opposite end 80 of the member 70 extends toward the rear of the housing 20 and serves as a terminal for completing the electrical circuit through the bulb 90. The end 80 of the member 70 is thus typically connected by a wire to electrical ground. The end 80 is also preferably dimpled to enable connection thereto by a wire connector.

To provide the desired resiliency to the contact members 60 and 70, both are preferably fabricated as integral units from an electrically conductive spring metal material.

When the hinge member 42 is in the position illustrated in FIG. 3, the electrical circuit through the bulb 90 is complete and the bulb 90 is energized. The bulb 90 is deenergized by pivoting the hinge member 42 into the position illustrated in FIG. 7 of the drawing. In the latter position, the finger 48 projecting from the hinge member 42 pushes downwardly on the bend 76 in the contact member 70 causing the bend 78 in the member 70 to move away from the shell of the bulb base 92. This opens the bulb circuit and de-energizes the bulb 90. When the hinge member 42 is released, the bend 76 biases the finger 48 and hinge member 42 back into the position illustrated in FIG. 3. The bend 78 again contacts the bulb base 92 causing the bulb 90 to again be energized.

Figure 6:
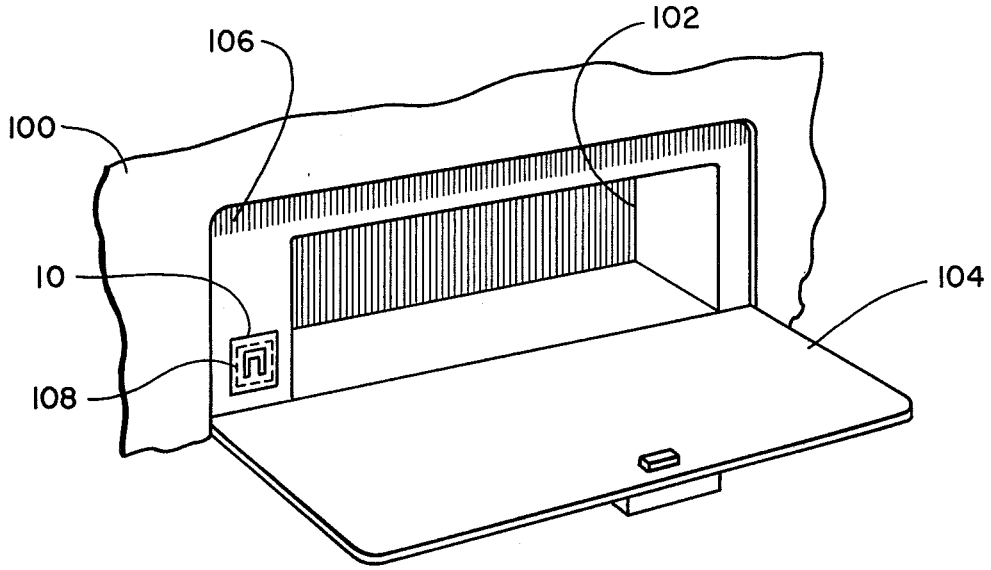
FIG. 6 illustrates a vehicle dashboard glove box compartment in which the switch of FIG. 1 is shown installed.

FIG. 6 of the drawing illustrates a typical application of the switch 10. A portion of a vehicle dashboard 100 is illustrated including a glove box compartment 102 having an access opening that is opened and closed by a closure lid 104 hinged to the dashboard along its bottom edge. The switch 10 is shown mounted in a panel 106 that covers a portion of the compartment opening. The panel 106 includes an aperture 108 dimensioned to receive and retain the housing 20 of the switch 10 in the manner described previously. The rear of the panel 106 is open to the compartment 102 so that, when the bulb 90 is energized, it illuminates the compartment 102.

Figure 7:
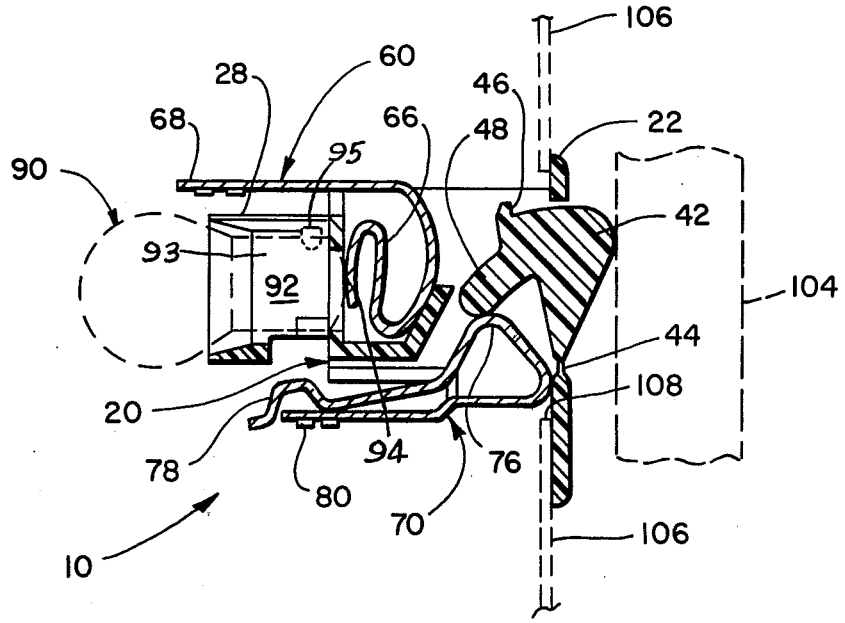
FIG. 7 is a side view in section similar to FIG. 3 but showing the condition of the switch when contacted by a closure lid.

The panel 106 is spaced sufficiently close to the front face of the dashboard 100 so that, when the lid 104 is closed, the lid 104 contacts and biases the hinge member 42 in the switch into the position indicated in FIG. 7. Thus, when the lid 104 isclosed, the bulb 90 is de-energized, whereas when the lid 104 is open, the bulb 90 is energized and the compartment 102 is illuminated.

As should now be appreciated, the switch 10, because of its simplicity and minimum number of operating parts, is particularly economical to manufacture. The housing 20, for example, can be fabricated from a suitable plastic, such as nylon, using an essentially one step molding process, such as injection molding. The spring contact members 60 and 70 can be stamped from a suitable spring metal stock, such as 12 mil spring steel, and mechanically bent to shape prior to assembly with the housing 20.

Tests performed upon the switch 10 indicate that it meets and exceeds automotive manufacturer's specifications for reliability and durability in use.

It should be understood that the above-described embodiment is intended to illustrate rather than limit the invention and that various modifications may be made thereto by those skilled in the art without departing from the scope of the invention as defined by the appended claims.

For example, it is not essential that the housing 20 be adapted to retain the lamp bulb 90. Rather, it is clearly possible to design the contact members 60 and 70 so that they are in electrical contact with each other, either by being in direct physical contact or in mutual contact with a conductive plug or other such element, for example, a terminal or the like which is electrically connected to the wires of a so-called capless or wedge-base bulb within the housing, when the hinge member 42 is in the position shown in FIG. 3, and so that the contact member 70 is moved to break this electrical contact when the hinge member 42 is moved to the position shown in FIG. 6. The switch 10 in such a modified form could thus be connected into an electrical circuit to control a component, such as the lamp bulb 90, that is mounted in a location remote from the switch. The switch 10 may also be used with closure members other than the vehicle glove box closure lid 104 mentioned above. It is thus the object of the appended claims to cover these and other modifications as come within the true spirit and scope of the invention.

What I claim as new and desire to secure by Letters Patent of the United States is:

1. A switch for mounting relative to a compartment having an access opening closable by a closure lid, said switch being activated to energize and de-energize a lamp bulb for illuminating the compartment in response to the opening and closing, respectively, of the closure lid, said switch comprising:

A. a housing for mounting relative to the compartment and including
   i. a lamp bulb receiving portion for receiving and retaining the bulb, and
   ii. a hinge member formed as an integral part of said housing and disposed so as to be engaged by the closure lid and pivoted from a first position to a second position in response to the closing of the lid;

B. a first contact member mounted to said housing and including
   i. a first end portion for connection into an electrical circuit, and
   ii. a second end portion for connecting to the bulb, and C. a second contact member mounted to said housing, electrically isolated from said first contact member and including
   i. a first end portion for connection into the electrical circuit,
   ii. a second end portion for contacting the bulb when said hinge member is in its first position thereby to complete the electrical circuit through the bulb and energize the bulb,
   iii. said second end portion being movable away from the bulb when said hinge member is pivoted to its second position thereby to open the electrical circuit and de-energize the bulb.

2. The switch of claim 1 in which said first and second contact members are each formed as an integral unit from a spring metal material.

3. The switch of claim 1 in which the bulb is of the type including a base having a tip and shell that are connectable into the electrical circuit to energize the bulb and in which the second end portion of the first contact member has the shape of an "S" and is disposed within said housing to resiliently contact the tip of the bulb base.

4. The switch of claim 1 in which the first end portion of said first contact member is formed as a terminal for connection to a voltage source in the electrical circuit.

5. The switch of claim 1 in which the bulb is of the type including a base having a tip and shell that are connectable into the electrical circuit to energize the bulb and in which the second end portion of said second contact member is disposed for contacting the shell of the bulb base.

6. The switch of claim 1 in which the first end portion of said second contact member is formed as a terminal for connection to electrical ground.

7. The switch of claim 1 in which said second contact member includes a portion intermediate to said first and second end portions that is engageable by said hinge member to move the second end portion of said second contact member away from the bulb when said hinge member is pivoted to its second position.

8. The switch of claim 7 in which said intermediate portion of said second contact member biases said hinge member into its first position.

9. The switch of claim 7 in which said intermediate portion of said second contact member is in the form of a node extending inwardly of said housing and said hinge member includes a finger projecting rearwardly into said housing and normally engaging the apex of said node when said hinge member is pivoted to its second position.

10. The switch of claim 1 in which said housing further includes:

iii. a front plate portion defining an opening through which said hinge member is pivotal, and iv. a pair of side members connecting said front plate portion to said bulb receiving portion.

11. The switch of claim 10 in which the compartment includes a panel disposed to be covered by the lid and defining an aperture having dimensions smaller than the dimensions of said front plate portion of said housing and in which said housing further includes v. a wing member projecting outwardly from each of said side members toward said front plate portion, said wing members being resiliently deformable inwardly toward said respective side members to enable said housing to be pushed through the aperture in the panel until said front plate portion contacts the panel, said wing members returning to their original position to retain said housing in the aperture, the panel being positioned close enough to the lid so that the lid, when closed, pivots said hinge member to its second position.

12. The switch of claim 10 in which said hinge member connects to said front plate portion of said housing by a connecting end portion that is thinned down relative to the remainder of said hinge member so as to facilitate the pivotal motion of said hinge member relative to said housing.

13. The switch of claim 10 in which said hinge member includes a lip disposed inwardly of said housing and adapted to engage an inner surface of said front plate portion to prevent said hinge member from being pulled through said opening in said front plate portion when said hinge member is in its first position.

14. The switch of claim 1 in which said housing is formed as an integral unit from a plastic material.

15. The switch of claim 14 in which said housing is formed from nylon.

16. A switch and lamp bulb assembly for mounting relative to a compartment having an access opening closable by a closure lid, said switch being activated to energize and deenergize a lamp bulb for illuminating the compartment in response to the opening and closing of the lid, said assembly comprising:

A. a switch housing for mounting relative to the compartment, said switch housing including i. a hinge member formed as an integral part of said housing and disposed to be engaged by the closure lid and pivoted from a first position to a second position in response to the closing of the lid;

B. a lamp bulb seated in said housing and having a bulb contact associated therewith;

C. a first switch contact member mounted to said housing and including i. a first portion for connection into an electrical circuit, and ii. a second portion connected to the bulb; and D. a second switch contact member mounted to said housing and electrically isolated from said first contact member and including i. a first portion for connection into an electrical circuit, and ii. a second portion contacting the bulb contact;

the electrical circuit through the bulb being completed and the bulb energized when the hinge member is in its first position and the electrical circuit through the bulb being broken responsive to movement of the second portion of at least one of said first and second contact members when the hinge member is pivoted to its second position.

17. The switch of claim 16 in which said housing is formed as an integral unit from a plastic material.

* * * * *